US006811472B2

(12) United States Patent
Tran et al.

(10) Patent No.: US 6,811,472 B2
(45) Date of Patent: Nov. 2, 2004

(54) INLINE LAPPING OF MAGNETIC TAPE

(75) Inventors: Nang T. Tran, Lake Elmo, MN (US); Arne B. Boberg, Shoreview, MN (US); Douglas R. Plourde, Somerset, WI (US); William R. Qualls, River Falls, WI (US); Edward L. Schneider, New Brighton, MN (US)

(73) Assignee: Imation Corp., Oakdale, MN (US)

( * ) Notice: Subject to any disclaimer, the term of this patent is extended or adjusted under 35 U.S.C. 154(b) by 166 days.

(21) Appl. No.: 10/047,373

(22) Filed: Jan. 14, 2002

(65) Prior Publication Data

US 2003/0064667 A1 Apr. 3, 2003

Related U.S. Application Data

(63) Continuation of application No. 09/967,018, filed on Sep. 28, 2001, now abandoned.

(51) Int. Cl.[7] ..... B24B 1/00

(52) U.S. Cl. ..... 451/54; 451/59; 29/603.16; 264/147; 264/162

(58) Field of Search ..... 451/54, 56; 29/603.14, 29/603.15, 603.16, 603.23, 603.27; 264/146, 147, 160, 162

(56) References Cited

U.S. PATENT DOCUMENTS

| | | | | | |
|---|---|---|---|---|---|
| 3,650,490 | A | * | 3/1972 | Saunders | 242/417.3 |
| 3,977,621 | A | * | 8/1976 | Huffman | 242/413.5 |
| 4,159,808 | A | * | 7/1979 | Meihofer | 242/413.1 |
| 4,280,669 | A | * | 7/1981 | Leanna et al. | 242/527.1 |
| 4,298,631 | A | | 11/1981 | Mikura et al. | |
| 4,519,757 | A | * | 5/1985 | Wittkopf et al. | 425/143 |
| 4,743,811 | A | * | 5/1988 | Katayama | 318/7 |
| 4,801,853 | A | * | 1/1989 | Lewis et al. | 318/7 |
| 4,858,265 | A | | 8/1989 | Suzuki et al. | |
| 4,888,212 | A | | 12/1989 | Iida et al. | |
| 4,984,119 | A | * | 1/1991 | Backlund et al. | 360/128 |
| 5,000,983 | A | | 3/1991 | Iida et al. | |
| 5,009,929 | A | | 4/1991 | Iida et al. | |
| 5,015,430 | A | | 5/1991 | Suzuki et al. | |
| 5,512,350 | A | * | 4/1996 | Ryoke et al. | 428/141 |
| 5,620,150 | A | * | 4/1997 | Min | 242/334 |
| 5,658,618 | A | * | 8/1997 | Schlatter et al. | 427/444 |
| 5,721,010 | A | * | 2/1998 | Hinoki et al. | 427/131 |
| 6,013,220 | A | | 1/2000 | Iwasaki | |
| 6,050,517 | A | * | 4/2000 | Dobrescu et al. | 242/417.2 |

FOREIGN PATENT DOCUMENTS

| | | |
|---|---|---|
| EP | 0 709 832 | 5/1996 |
| JP | 63-098832 | 4/1988 |
| JP | 63- 181120 | 7/1988 |
| JP | 01-258224 | 10/1989 |
| JP | 03-212820 | 9/1991 |
| JP | 04-121818 | 4/1992 |
| JP | 06-150306 | 5/1994 |
| JP | 07-21557 | 1/1995 |
| JP | 2000-090433 | 3/2000 |
| JP | 2001-006167 | 1/2001 |

* cited by examiner

*Primary Examiner*—M. Rachuba
(74) *Attorney, Agent, or Firm*—Eric D. Levinson

(57) ABSTRACT

In one embodiment, the invention is directed toward inline lapping of magnetic tape. The lapping process is performed inline with one or more other magnetic tape manufacturing processes. In this manner, the number of times the magnetic tape is un-spooled and then re-spooled can be reduced. Consequently, the amount of handling of the individual tape pancakes can also be reduced, thus avoiding damage to the edge of the tape, or other damage associated with tape pancake handling.

15 Claims, 11 Drawing Sheets

INLINE LAPPING OF MAGNETIC TAPE

This is a continuation of application Ser. No. 09/967,018 filed on Sep. 28, 2001 abn.

TECHNICAL FIELD

The invention relates to magnetic recording media, and in particular, lapping of magnetic tape.

BACKGROUND

Magnetic tape is often used for storage and retrieval of data, and comes in many widths and lengths. Magnetic tape remains an economical medium for storing large amounts of data. For example, magnetic tape cartridges or spools of magnetic tape are often used to back up large amounts of data for large computing centers. Magnetic tape cartridges also find application in the backup of data stored on smaller computers such as workstations, desktop computers and laptop computers.

The creation of magnetic tape involves a number of different processing steps. For example, the processing may start with a wide roll of polymeric film, sometimes referred to as a stockroll. The wide film is then coated in a coating process. For example, the wide roll of film may be coated with a nonmagnetic underlayer followed by a magnetic layer on the front side and another layer on the back side to create a wide roll of magnetic tape. A calendaring process then is used to compress and smooth the coated magnetic material on the tape. The coating and calendaring processes typically require the tape to be un-spooled from a first stockroll and then re-spooled onto a second stockroll. After coating and calendaring, the wide roll of tape is typically cut in a slitting process to realize a number of narrow magnetically coated tape strands cut to the desired width. Again, this requires the roll of tape to be un-spooled. Each individually cut strand of magnetic tape typically is then re-spooled, and the individually spooled strands can be separated to realize individual "tape pancakes." In this disclosure, a "tape pancake" refers to a spool of magnetic tape that has been cut to a desired width.

Each individual tape pancake is then typically un-spooled again and then burnished and wiped before being re-spooled. For example, the tape in each individual tape pancake may be burnished by scraping, vaming, lapping, or a combination of different burnishing techniques. Scraping techniques typically involve feeding the tape past a scraping mechanism to smooth or alter the surface of the tape. Vaming techniques utilize a rotating cylinder that rotates in a direction opposite the direction of incoming tape. The rotating cylinder, for example, is typically coated with industrial grade diamonds to smooth or alter the surface of the tape as it passes by and contacts the rotating cylinder. Lapping techniques are more complicated, but are generally more effective in burnishing the surface of the tape. Lapping techniques utilize a lapping film that is fed in a direction opposite the direction of incoming tape. For example, the lapping film may pass in one direction over a supporting structure referred to as a lapping shoe. The tape is passed over the lapping shoe in the opposite direction. The lapping shoe forces the lapping film into contact with the surface of the tape as the tape and lapping film feed past one another in opposite directions. In this manner, the lapping film can be used to effectively burnish the surface of the tape.

After burnishing, the tape is typically degaussed in a degaussing process. If desired, servo patterns can be magnetically written on the tape, and the tape may be spooled into a cartridge, which can then be sold as a magnetic tape cartridge. Alternatively, the burnished tape pancake may be sold with or without writing the servo patterns on the tape.

The various processing steps involved in producing magnetic tape are conventionally performed as separate and distinct stages. For example, the slitting process is typically performed independently from the other processes. Consequently, for each processing stage, the tape is typically un-spooled and processed, and then re-spooled. For this reason, each individual tape pancake typically requires handling by operators after slitting and prior to burnishing. This repeated handling can reduce media quality. In addition, the repeated spooling and un-spooling of the tape complicates the manufacturing process and can increase manufacturing costs.

SUMMARY

In general, the invention is directed to techniques for inline lapping of magnetic tape. The lapping process is "inline" in the sense that it is performed with one or more other magnetic tape manufacturing processes. In this manner, the invention is capable of reducing the number of times the magnetic tape is un-spooled and then re-spooled. Consequently, the amount of handling of the individual tape pancakes can also be reduced, thus avoiding damage to the edge of the tape, or other damage associated with tape pancake handling. Reducing the number of times the magnetic tape is spooled and un-spooled can also simplify the manufacturing process.

In various embodiments, the invention provides methods, apparatuses and systems for realizing inline lapping. Again, inline lapping refers to a lapping process that is integrated with one or more other tape processing steps. In other words, inline lapping does not require the tape to be un-spooled and then re-spooled solely for the lapping step of the magnetic tape manufacturing process. Rather, when the tape is un-spooled, both lapping and one or more other processing steps, such as the slitting process can be performed before the tape is re-spooled. Inline lapping can improve throughput, and at the same time may improve media quality.

In one embodiment, the invention integrates the tape slitting process and the lapping process into a single inline process. For example, a method may include un-spooling a roll of wide magnetic tape and cutting the wide magnetic tape into a number of individual narrow magnetic tape strands. The method may also include lapping each of the individual narrow magnetic tape strands prior to re-spooling, and then re-spooling each of the individual narrow magnetic tape strands. The tape may also be wiped or otherwise cleaned to remove debris prior to re-spooling. In particular, an inventive wipe unit as described in detail below can provide effective wiping of magnetic tape, especially at the tape edges.

For inline lapping to be more effective, the tension in each of the individual narrow magnetic tape strands can be separately controlled. For example, separately controlling tension in each of the individual narrow magnetic tape strands may involve controlling the torque with a number of magnetic clutch mechanisms, wherein each of the number of magnetic clutch mechanisms correspond to one of the individual narrow magnetic tape strands. Separate tension control for the individually cut narrow magnetic tape strands can help ensure that the lapping is more effective to smooth the magnetic surface of the tape and thereby reduce the likelihood of errors in the magnetic coating on the tape. In particular, tension control can make the result of the lapping process more uniform from strand to strand.

In one particular case, after cutting the wide magnetic tape into a number of individual narrow magnetic tape strands, the tape strands are separated into even numbered individual narrow magnetic tape strands and odd numbered individual narrow magnetic tape strands. In other words, individually cut narrow magnetic tape strands are separated such that every other strand is fed through one of two lapping units on an alternating basis. Thus, the even and odd numbered tape strands are formed adjacent one another in the slitting process, but separated for the lapping process.

In another embodiment, the invention is directed toward a lapping station for lapping magnetic tape. For example, the lapping station may include a first lapping unit that laps a first set of magnetic tape strands, and a second lapping unit that simultaneously laps a second set of magnetic tape strands. For example, even numbered individual narrow magnetic tape strands can be grouped in the first set and odd numbered individual narrow magnetic tape strands can be grouped in the second set. The first set of tape strands can be lapped by the first lapping unit, and the second set of tape strands can be lapped by the second lapping unit. The lapping units in the lapping station may adjustably engage the respective sets of magnetic tape strands. In this manner, the degree of lapping can be effectively controlled for each of the sets of tape strands on an independent basis. In some embodiments, a number of lapping units lap the first set of magnetic tape strands and a different number of lapping units simultaneously lap the second set of magnetic tape strands. For example, the different lapping units associated with each set of magnetic tape strands may lap different sides of the tape strands, or may utilize different lapping films to improve lapping on a given side of the tape strands.

The lapping station may further include wiping units or other cleaning units to wipe and clean the magnetic tape strands after the tape strands have been lapped. For example, the lapping station may include a first wiping unit that wipes the first set of magnetic tape strands, and a second wiping unit that simultaneously wipes the second set of magnetic tape strands. Each wiping unit may include a vacuum in fluid communication with a number of apertures to respectively draw the magnetic tape strands against a wiping material. The wiping material can move over the apertures in a direction opposite the magnetic tape strands. The vacuum can draw the tape strands into the apertures to improve wiping, especially at the edges of the tape strands.

In still another embodiment, the invention is directed toward an inline tape manufacturing system. For example, the system may include a slitting station that cuts a wide magnetic tape into a number of individual narrow magnetic tape strands, and a lapping station that simultaneously laps the number of individual narrow magnetic tape strands prior to re-spooling. The system may also include a re-spooling station that spools the number of individual narrow magnetic tape strands. Each re-spooled strand can then be removed to realize individual tape pancakes.

The slitting station can separate the number of individually cut narrow magnetic tape strands into even numbered individual narrow magnetic tape strands and odd numbered individual narrow magnetic tape strands. The lapping station may include one or more of the features described above, including lapping units and wiping units for lapping and wiping the individually cut narrow magnetic tape strands.

The rewind station may include tension control units to control tension in the individual narrow magnetic tape strands. In particular, the rewind station may include a first tension control unit to control tension in even numbered individual narrow magnetic tape strands and a second tension control unit to control tension in odd numbered individual narrow magnetic tape strands. For example, each of the first and second tension control units may include magnetic clutch mechanisms as described in greater detail below.

In still another embodiment, wide magnetic tape is passed through a lapping station that laps and possibly wipes the wide magnetic tape. The wide magnetic tape can then be sent through a slitting station to cut the wide magnetic tape into a number of individual narrow tape strands. The narrow strands may be lapped or wiped again, or otherwise cleaned prior to re-spooling.

The invention can provide a number of advantages. For example, inline lapping can improve burnishing compared to conventional burnishing techniques that utilize scraping or vaming. This, in turn, can directly improve media quality. In particular, inline lapping can smooth the surface of tape and reduce errors in the tape better than conventional vaming or scraping techniques.

Inline lapping can also improve throughput of the overall tape manufacturing process by allowing multiple individually cut narrow magnetic tape strands to be lapped simultaneously. This can save both time and capital resources. For example, conventional tape manufacturing systems may require a number of conventional lapping units to lap each individual tape pancake. The invention, in contrast, can replace the number of conventional lapping units with a single lapping station.

Moreover, because an intermediate step of un-spooling and then re-spooling the magnetic tape pancakes can be avoided in accordance with the invention, media quality can be improved. In particular, avoiding the intermediate un-spooling/re-spooling step can reduce the chance of airborne particles corrupting the tape. In addition, avoiding the intermediate un-spooling/re-spooling step can reduce the amount of handling of the tape pancakes by operators. Handling can cause damage to the tape, especially at the tape edges.

Additional advantages in terms of media quality can be achieved by incorporating wipe units in the inline lapping station. In particular, the wipe units described herein can provide improved media quality by removing debris from the tape. The wipe units described in greater detail below are particularly effective at removing dust and debris near the edges of the tape strands.

Inline lapping can also save time and energy by avoiding the need to clean rollers on conventional lapping units. For example, if a number of conventional lapping units are used, each lapping unit may require cleaning prior to lapping each individual tape pancake. The invention, however, can simultaneously lap a large number of individually cut magnetic tape strands using a lapping station. The time it takes to clean the lapping station may be significantly less than the time it takes to clean multiple conventional lapping units.

Still other advantages relate to the reduced complexity of the manufacturing process. The invention can reduce the number of stages involved in tape manufacturing by integrating the lapping stage with one or more other tape manufacturing stages, such as the tape slitting stage. This can reduce cost and complexity of the overall tape manufacturing process. In addition, inline lapping may reduce the amount of time it takes to manufacture magnetic tape.

Additional details of various embodiments are set forth in the accompanying drawings and the description below.

Other features, objects, and advantages of the invention will be apparent from the description and drawings, and from the claims.

DETAILED DESCRIPTION

Figure 1:
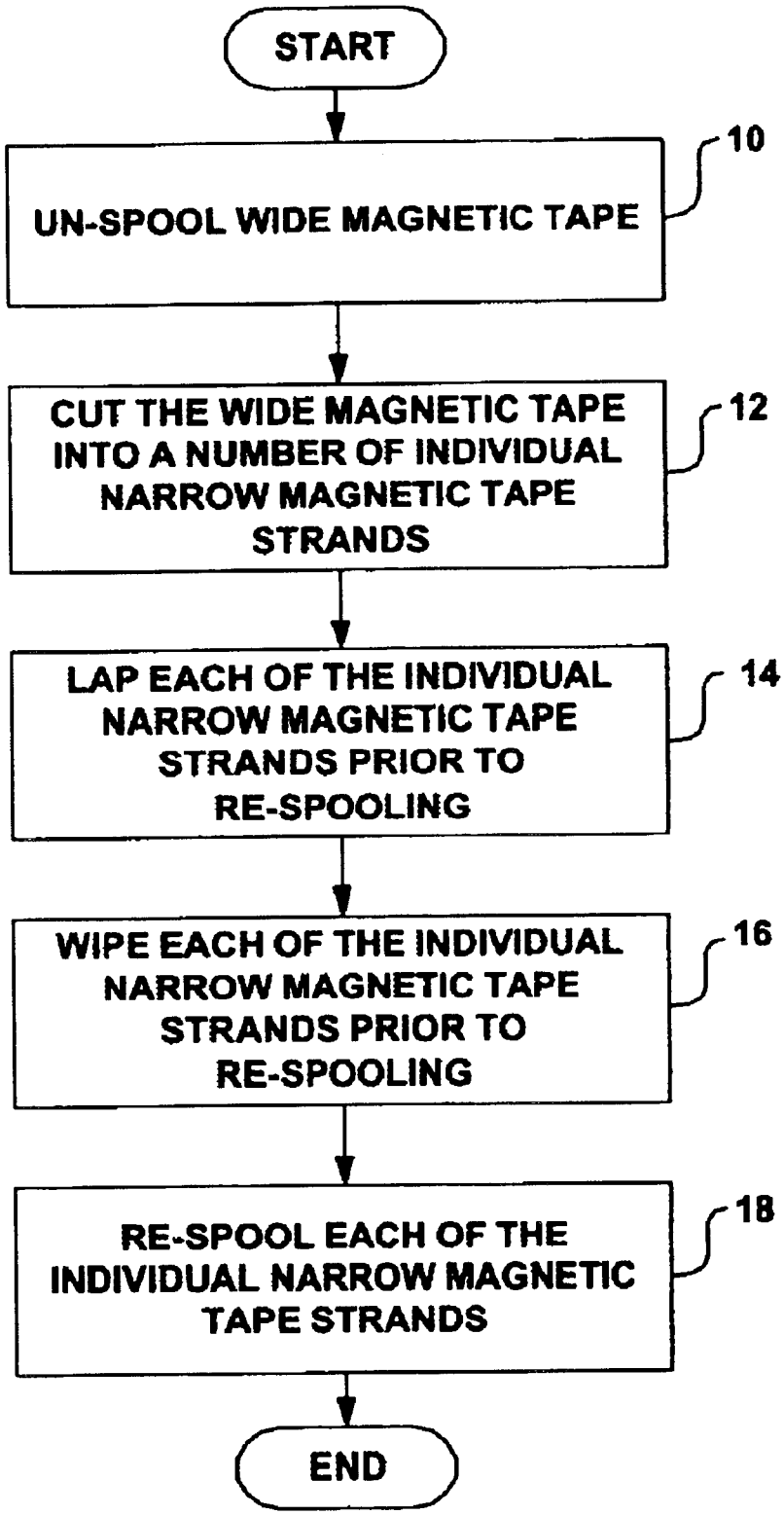
FIG. 1 is a flow diagram illustrating a process for lapping magnetic tape according to an embodiment of the invention.

FIG. 1 is a flow diagram according to an embodiment of the invention. As shown, wide magnetic tape is un-spooled (10). The wide magnetic tape can then be cut into a number of individual narrow magnetic tape strands (12). For example, a slitting station may be used to cut the wide magnetic tape into the number of individual narrow magnetic tape strands. In this disclosure, the terms "narrow magnetic tape strands" and "wide magnetic tape" are relative terms. In other words, the term wide magnetic tape refers to magnetic tape prior to being cut into two or more narrow magnetic tape strands. The term narrow magnetic tape strand refers to magnetic tape that has been cut from a relatively wider magnetic tape. The invention is not limited to the actual widths of the tapes. For example, wide magnetic tape could have any width. Similarly, narrow magnetic tape strands could have any width, and must only be narrow in relation to the wide tape from which it was cut. In many cases, the narrow magnetic tape strands are cut to a size desirable for use in a data storage cartridge.

After cutting the wide magnetic tape into a number of narrow magnetic tape strands, each of the individual narrow magnetic tape strands are lapped prior to re-spooling (14). In particular, a lapping station can be used to lap the narrow magnetic tape strands after the strands are cut, but before the strands are re-spooled. For example, the lapping station may include a number of different lapping units for simultaneously lapping the narrow magnetic tape strands. In one embodiment, the slitting station cuts the wide magnetic tape and separates the individual narrow magnetic tape strands into a first set comprising the even numbered narrow magnetic tape strands and a second set comprising the odd numbered narrow magnetic tape strands. The even and odd numbering refers to the cross-web position of the narrow magnetic tape strands across the wide magnetic tape. The lapping station may include a first lapping unit that laps the first set of narrow magnetic tape strands and a second lapping unit that laps the second set of narrow magnetic tape strands. Separating the strands into odd and even numbered strands can avoid edge contact between individual strands and can provide adequate space between the stands to facilitate individual tension control. In addition, separating the strands can facilitate mechanical arrangement in the rewind station.

Each lapping unit may include a lapping shoe. As described in greater detail below, a lapping film may pass over the lapping shoe in one direction, and the magnetic tape strands can pass over the shoe in the opposite direction. In some embodiments, the lapping units are adjustably engageable with the magnetic tape. In addition, any number of lapping units, each having a lapping shoe, can be used to lap sets of magnetic tape. The lapping material is renewable as it is used, reducing the need for cleaning and maintenance of the lapping station.

After lapping the individual narrow magnetic tape strands (14), the strands can be wiped or otherwise cleaned (16). For example, one or more wiping units within the lapping station can be used to wipe the tape strands. In some cases, separate wiping units can be used to wipe both the top and the bottom sides of the tape strands. In particular, the wiping units may utilize a vacuum to draw the tape strands next to the wiping material and more effectively wipe the surface and edges of the tape strands. After being lapped and wiped, each of the individual narrow magnetic tape strands can then be re-spooled (18).

Inline lapping can improve throughput of the overall tape manufacturing process by allowing multiple individually cut narrow magnetic tape strands to be lapped simultaneously. Moreover, media quality can be improved because an intermediate step of un-spooling and then re-spooling the magnetic tape pancakes is avoided. The amount of media handing, which can negatively effect the quality of the tape media, is reduced. In addition, the chance of airborne particles contaminating the tape media is reduced in an inline processing system because the tape may be exposed to the atmosphere for less time.

Figure 2:
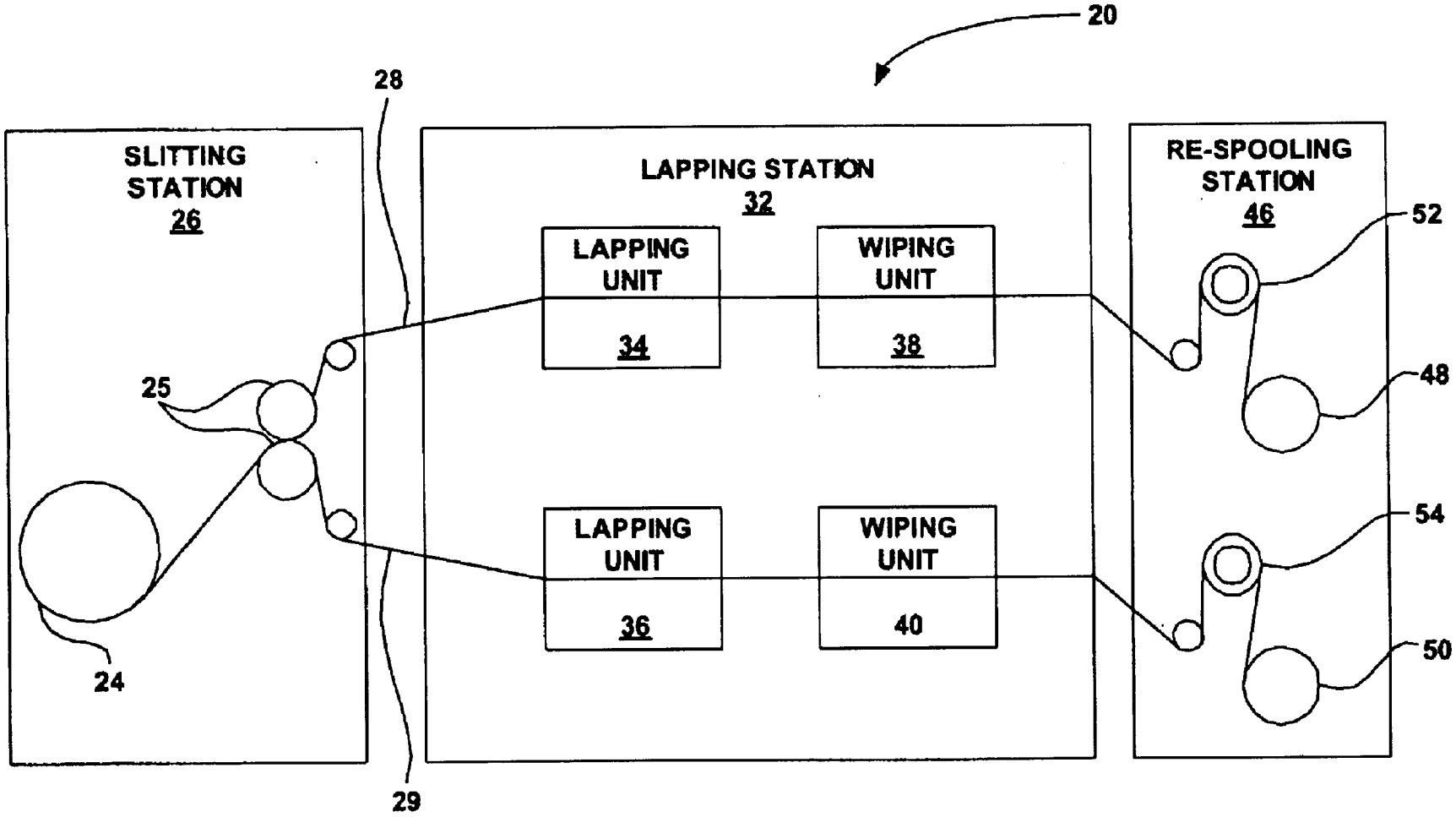
FIG. 2 is a block diagram of an exemplary inline lapping system according to the invention.

FIG. 2 is a block diagram of an exemplary inline lapping system 20 according to the invention. Lapping system 20 includes a slitting station 26, in which a roll 24 of wide magnetic tape is fed into a cutting mechanism 25. The cutting mechanism 25 cuts the wide magnetic tape in a longitudinal direction, producing a number of narrow magnetic tape strands having desired widths. In addition, the slitting station 26 separates the narrow magnetic tape strands into a first set 28 and a second set 29. For example, first set 28 may be referred to as even numbered narrow magnetic tape strands and second set 29 may be referred to as odd numbered narrow magnetic tape strands, based on their cross-web positions among the narrow magnetic tape strands. The invention, however, is not necessarily limited in that respect.

The magnetic tape strands can be fed out of the slitting station 26 and into lapping station 32. The lapping station 32 may include a number of lapping units oriented to lap either or both sides of the magnetic tape strands. By way of example, first and second lapping units 34, 36 are illustrated, although any number of lapping units may be used in accordance with the invention. For example, the first set of magnetic tape strands 28 can be fed into first lapping unit 34 and the second set of magnetic tape strands 29 can be fed into second lapping unit 36. The lapping units 34, 36 simultaneously lap the individual narrow magnetic tape strands. Lapping smoothes the surfaces of the tape strands, promoting uniformity of the magnetic head-to-tape interface, and can reduce errors within the magnetic material coated on the tape. In particular, lapping can improve media quality compared to other burnishing techniques such as scraping or vamping. Additional details of the lapping units are provided below.

Lapping station 32 may also include a number of wiping units oriented to wipe either or both sides of the magnetic tape strands. By way of example, first and second wiping units 38, 40 are illustrated, although any number of wiping units may be used in accordance with the invention. Each wiping unit may include a vacuum in fluid communication with a number of apertures. A wiping material passes over the wiping unit in one direction and the respective set of magnetic tape strands may pass over the wiping unit in the other direction. The vacuum can draw the magnetic tape strands into the apertures to improve the wiping of the tape, particularly at the tape edges. Additional details of wiping units are described below.

After passing through lapping station 32 the tape strands can be re-spooled in re-spooling station 46. For example, the first set of magnetic tape strands 28 can be re-spooled onto spool 48, e.g., a re-wind spool, and the second set of magnetic tape strands 29 can be re-spooled onto another spool 50, e.g., another rewind spool. The narrow strands of tape in each set of magnetic tape strands 28, 29 are respectively spooled with spaces between the spooled strands. The spaces between the strands in one set correspond to the tape strands in the other set, which are spooled onto a different spool. After being re-spooled, each individual strand of tape can then be removed from the respective rewind spool as an individual tape pancake. As an alternative, the system could re-spool each individual strand of tape on separate spools rather than spooling the strands in the first set 28 on rewind spool 48 and spooling the strands in the second set 29 on rewind spool 50. In that case, the individual tape pancakes would not need to be removed from the spools. However, the addition of individual spools for each tape strand would add complexity to the system.

Re-spooling station 46 may include tension control units 52, 54 to control tension in the individual strands of magnetic tape. For example, each tension control unit 52, 54 can control tension in the strands of tape in the respective first and second sets of magnetic tape strands. In particular, a first tension control unit 52 can be used to individually control tension in each strand of tape in the first set of magnetic tape strands 28 and the second tension control unit 54 can be used to individually control tension in each strand of tape in the second set of magnetic tape strands 29. Individual tension control can improve media quality and consistency by ensuring that the various strands of magnetic tape are lapped in a substantially uniform manner. Additional details of the tension control units are provided below.

Figure 3:
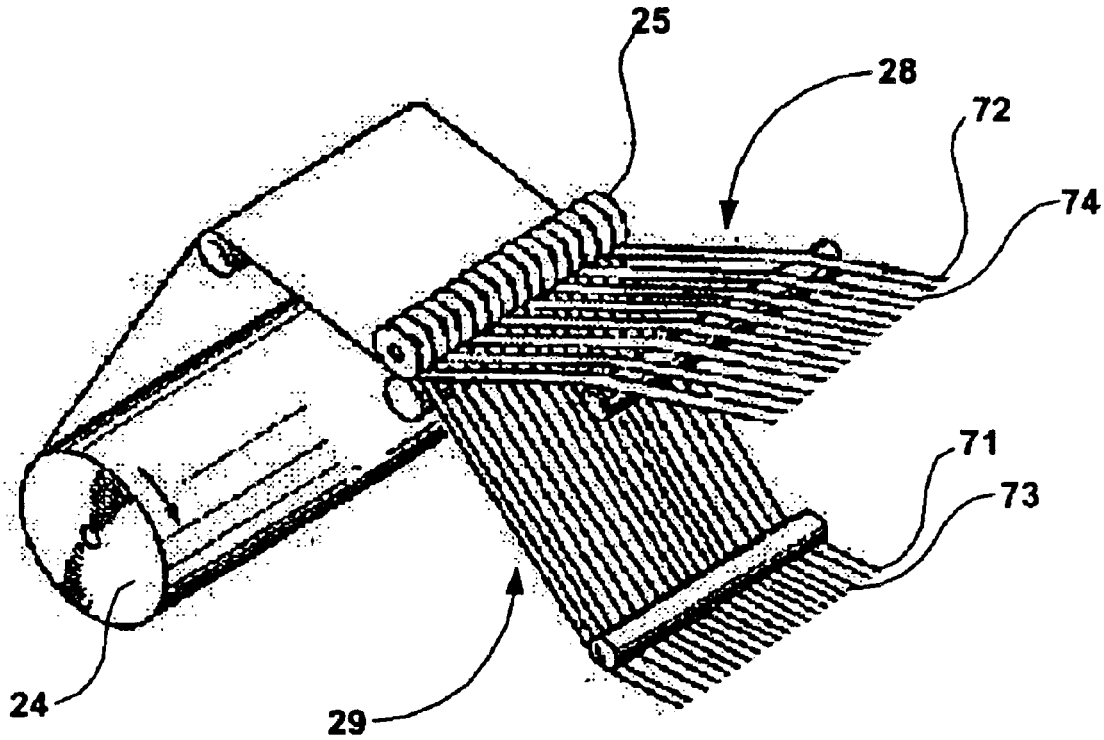
FIG. 3 is a perspective view illustrating an embodiment of a suitable slitting unit that could be used in the inline lapping system.

Referring back to the beginning of the inline lapping process, FIG. 3 is a perspective view illustrating an embodiment of a suitable slitting station 26 that could be used in the inline lapping system according to the invention. In particular, a roll 24 of wide magnetic tape feeds into cutting mechanism 25, which cuts the wide magnetic tape into a number of strands, i.e., a number of narrow magnetic tape strands. Slitting station 26 also separates the strands into a first set of narrow magnetic tape strands 28 and a second set of narrow magnetic tape strands 29. For example, the first set of narrow magnetic tape strands 28 may comprise even numbered strands, and the second set of narrow magnetic tape strands 29 may comprise odd numbered strands. In other words, a first strand 71 is in the second set 29, a second strand 72 is in the first set 28, a third strand is in the second set 29, a fourth strand is in the first set 28, and so forth. The first and second sets of narrow magnetic tape strands 28, 29 are then fed into lapping station 32 to be simultaneously lapped and possibly wiped prior to re-spooling.

Figure 4:
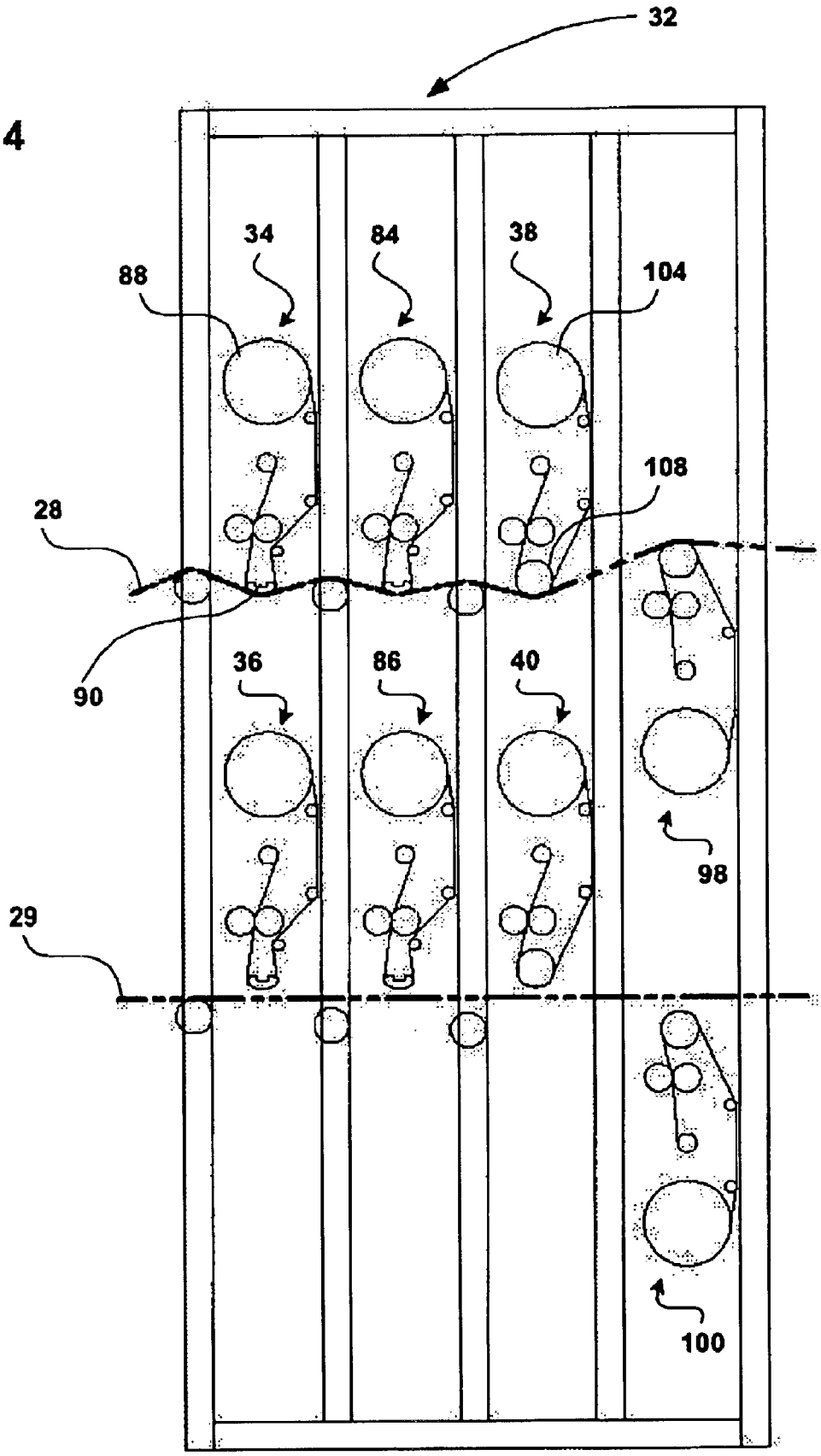
FIG. 4 is a side view illustrating an exemplary lapping station in greater detail.

FIG. 4 is a side view illustrating an exemplary lapping station 32 in greater detail. In particular, lapping station 32 includes first lapping unit 34 and second lapping unit 36 that separately and simultaneously lap the first and second sets of narrow magnetic tape strands 28, 29. Additional lapping units 84, 86 may also be included in lapping station 32 to more effectively lap the sets of narrow magnetic tape strands 28, 29.

The lapping units will now be described with reference to first lapping unit 34. Second lapping unit 36 and the other lapping units 84, 86 may operate in a substantially similar manner. Lapping unit 34 includes a roll of lapping film 88 that is fed over lapping shoe 90 in a first direction. A set of narrow magnetic tape strands 28 travel over lapping shoe 90 in a second direction, which is opposite the first direction. The lapping shoe forces lapping film 88 into contact with the surface of the set of narrow magnetic tape strands 28 as the tape strands and lapping film 88 feed past one another in opposite directions. In this manner, lapping film 88 laps strands in the set of narrow magnetic tape strands 28. Lapping film 88 may be a relatively wide film having sufficient width to lap every strand in the set of narrow magnetic tape strands 28. Alternatively, lapping film 88 may include a number of lapping strands, wherein each strand laps a strand in the set of narrow magnetic tape strands 28. Suitable lapping films, for example, include silicone carbide films, aluminum oxide films, diamond films, or the like. If multiple lapping units are used to lap the same strands of tape, various different lapping films or films having various different grit sizes could be used in the different lapping units. Suitable lapping films such as silicon carbide films having grit sizes of 0.5 microns, 1.0 microns, and 3 microns are commercially available form 3M Abrasive Systems Division of Minnesota Mining and Manufacturing Co. of Saint Paul, Minn., or USF Surface Preparation of Maple Grove, Minn.

Lapping techniques provide big advantages over conventional scraping or vaming techniques. In particular, lapping can burnish the surfaces of the magnetic tape strands more effectively than scraping or vaming. Lapping films are renewable in the sense that the surface area of the lapping film is typically used only once to burnish the tape surface. New lapping film can be loaded into the lapping unit as needed. The renewable aspect of lapping films makes lapping a much cleaner process than vaming or scraping. In contrast, vaming and scraping techniques reuse the same rotating cylinder (in the case of vaming) or the same scraping mechanism (in the case of scraping). Consequently, scraping and vaming techniques are typically plagued with debris build up in the system. This debris can reduce the effectiveness of burnishing and typically requires the vaming or scraping unit to be periodically cleaned. In contrast, lapping is a much cleaner process, which improves the quality and consistency of the burnishing.

The lapping units 34, 84, 36, 86 adjustably engage the sets of narrow magnetic tape strands 28, 29. Lapping units 34 and 84 are illustrated as engaging the first set of narrow magnetic tape strands 28, while lapping units 36, 86 are illustrated as being in an unengaged position. Adjustable engagement allows the lapping units to be positioned so as to achieve the desired level of burnishing on the tape. The level of engagement can control the amount of force applied by the lapping shoe on the tape strands. The desired amount of engagement may be dependent or co-dependent upon a number of factors, including the amount of tension in the individual strands of magnetic tape, the type of lapping film used, and the desired amount of burnishing. In some cases, for example, lapping unit 84 is more engaged or less engaged than lapping unit 34 to provide a cascading effect of improved lapping.

Figure 5:
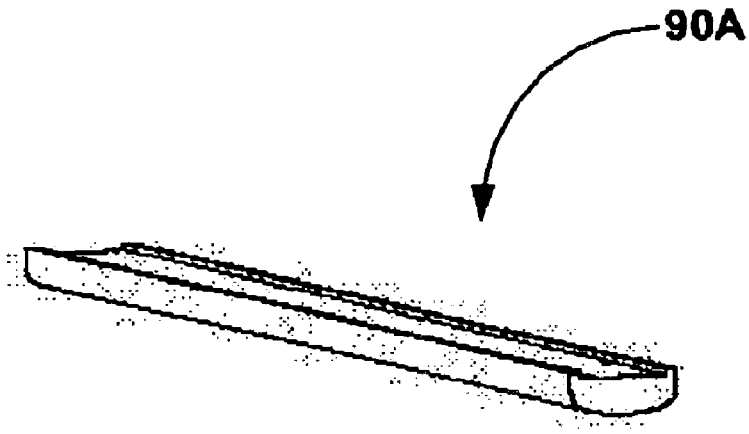
FIGS. 5–12 are exemplary embodiments illustrating a number of lapping shoe configurations.
Figure 6:
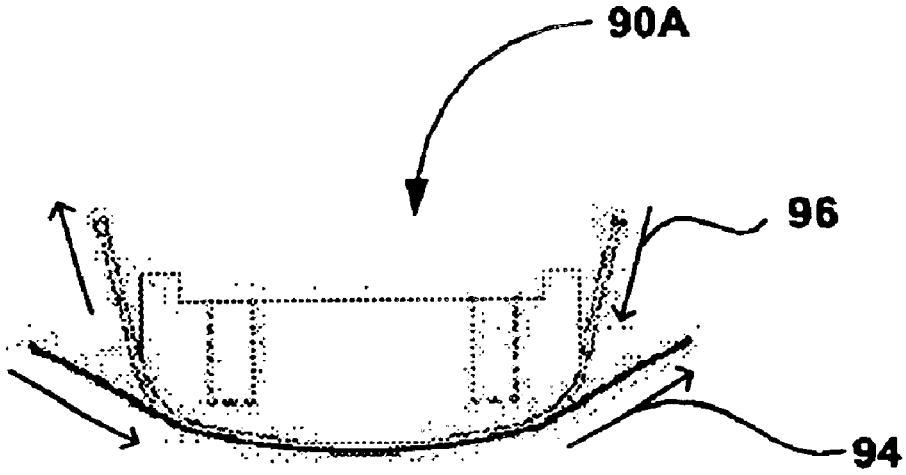

FIGS. 5–12 are exemplary embodiments illustrating a number of lapping shoe configurations. In particular, FIGS. 5 and 6 illustrate lapping shoe 90A having a horseshoe-like configuration. FIG. 5 is a perspective view and FIG. 6 is a cross-sectional view. Again, a set of magnetic narrow magnetic tape strands, e.g., first set 28 or second set 29, passes by lapping shoe 90A in a first direction 94. Lapping film 88 passes over lapping shoe 90A in a second direction 96, which is opposite the first direction 94. In this manner, lapping film 88 can effectively burnish the surface of the narrow magnetic tape strands.

Figure 7:
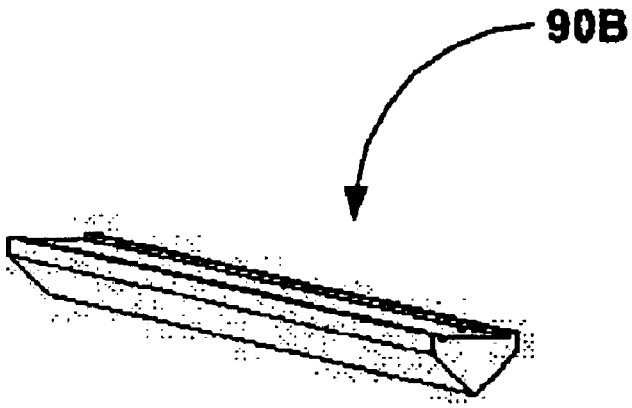
Figure 8:
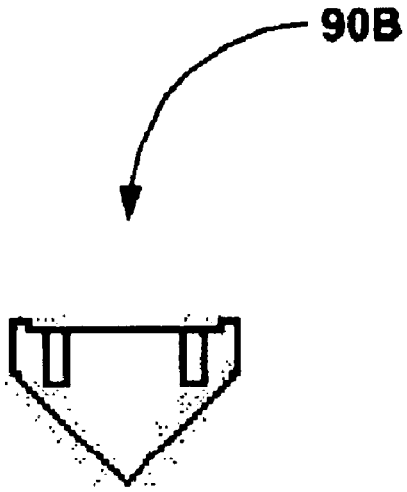
Figure 9:
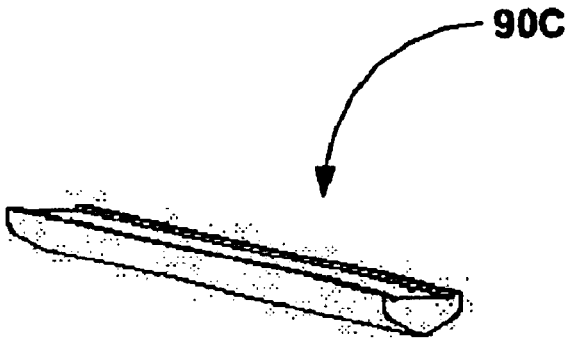
Figure 10:
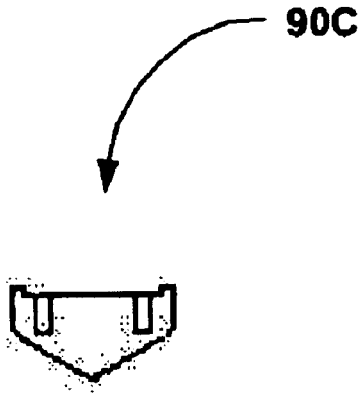

FIGS. 7–8 and 9–10 illustrate exemplary embodiments of lapping shoes 90B and 90C respectfully, having triangular configurations. FIGS. 7 and 9 are perspective views and FIGS. 8 and 10 are cross-sectional views. As can be appreciated by FIGS. 7–10, the shape of the triangle can be chosen to optimize the lapping effect for a given type of magnetic tape and given level of tension. Lapping films can also be chosen, depending on the desired lapping effect. For example, if a number of lapping units are used for the same set of magnetic tape strands, as illustrated in FIG. 4, different lapping shoe configurations and/or different lapping films may be used for lapping unit 34 and lapping unit 84 to provide a cascading effect of improved lapping.

Figure 11:
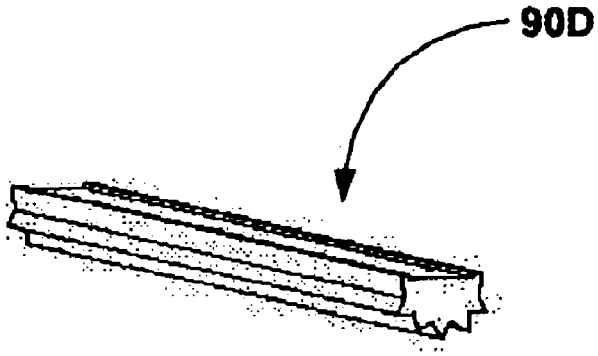
Figure 12:
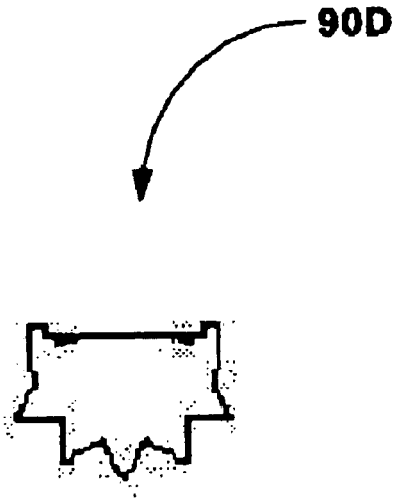

FIGS. 11 and 12 illustrate yet another embodiment of lapping shoe 90D. FIG. 11 is a perspective view and FIG. 12 is a cross sectional view. As shown, lapping shoe 90D has a star-like configuration in which tape and lapping material pass by a number of spikes. The star like configuration of lapping shoe 90D creates several points of discrete contact where the lapping film is forced against the tape strands. For some tape media, such a configuration can improve the lapping effect.

In addition to lapping units, lapping station 32 may include wiping units to wipe the magnetic tape clean. Wiping the magnetic tape after lapping can improve media quality by removing dust or debris from the front or back side of the tape. The edges of the tape, in particular, may need to be effectively wiped in an inline lapping system, especially if the tape is cut during the inline manufacturing process. Cutting the tape can cause debris to exist on the tape edges. Wiping the tape edges, however, can remove the debris and thereby improve tape media quality. Other types of cleaning units could also be added.

Referring again to FIG. 4, lapping station 32 may include a first wiping unit 38 and second lapping unit 40 that separately and simultaneously wipe the first and second sets of narrow magnetic tape strands 28, 29. Additional wiping units 98, 100 may also be included in lapping station 32 to more effectively wipe the sets of narrow magnetic tape strands 28, 29. For example, wiping units 38 and 40 can be used to wipe the top sides of the sets of narrow magnetic tape strands 28, 29, and wiping units 98 and 100 can be used to wipe the bottom sides of the sets of narrow magnetic tape strands.

The wiping units will now be described with reference to first wiping unit 38. Second wiping unit 40 and the other wiping units 98, 100 may operate in a substantially similar manner. Wiping unit 38 includes a roll of wiping material 104 that is fed over wipe head 108 in a first direction. A set of narrow magnetic tape strands 28 travel in a second direction, which is opposite the first direction. In this manner, wiping material 104 wipes strands of tape in the set of narrow magnetic tape strands 28. Wiping material 104 may be a relatively wide sheet of material, having sufficient width to wipe every strand in the set of narrow magnetic tape strands 28. Alternatively, wiping material 104 may include a number of wiping strands, wherein each wiping strand wipes a strand in the set of narrow magnetic tape strands 28. Suitable wiping materials, for example, include Toraysee 52000TR film commercially available from Toray Industries Inc. of Tokyo, Japan; Toyobo film commercially available from Toyobo Inc. of Osaka, Japan; Verateck film commercially available from BBA NonWovens of North Carolina, U.S.A.; Sterling electrolyte film commercially available from Stearns Technical Textile of Ohio, U.S.A; and HDK wiping fabric commercially available from Bonar Fabric of Greenville, S.C., U.S.A. Other wiping materials could also be used.

Like the lapping units, the wiping units 38, 98, 40, 100 adjustably engage the sets of narrow magnetic tape strands 28, 29. Wiping units 38 and 98 are illustrated as engaging the first set of narrow magnetic tape strands 28, while wiping units 40 and 100 are illustrated as being in an unengaged position. Adjustable engagement allows the wiping units to be positioned so as to improve the wiping effect. The level of engagement may be dependent or co-dependent upon a number of factors including the amount of tension in the individual strands of magnetic tape and the wiping material used. When engaged, wiping units 38 and 98 can wipe the tops of the sets of narrow magnetic tape strands 28, 29, and wiping units 40 and 100 can wipe the bottoms of the sets of narrow magnetic tape strands. Additional wiping units could also be used.

Figure 13A:
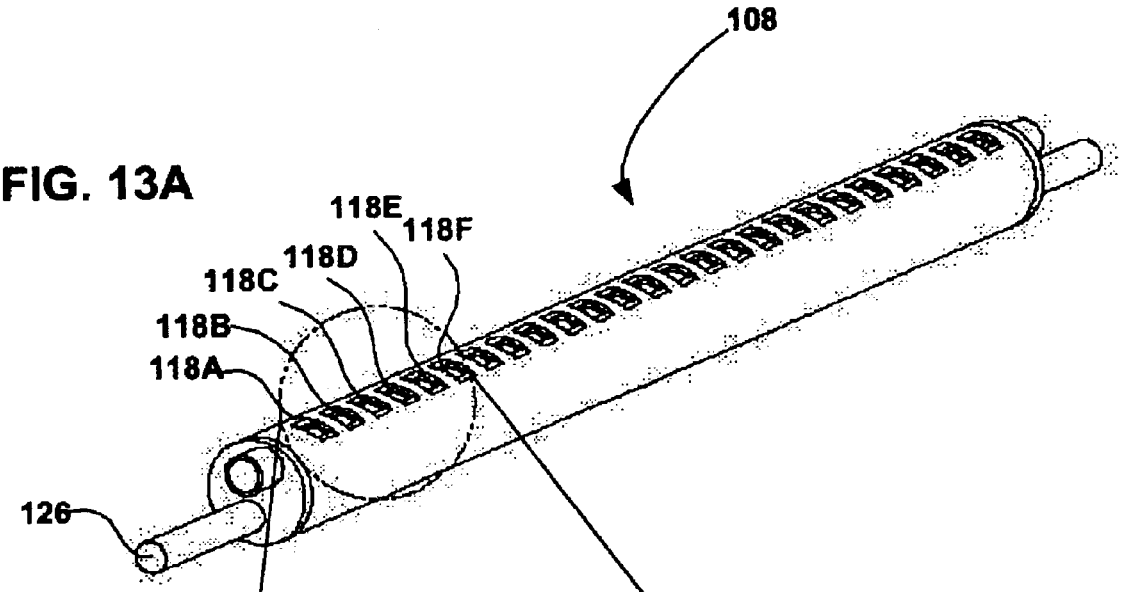
FIGS. 13A and 13B are perspective views illustrating one embodiment of a wipe head.
Figure 13B:
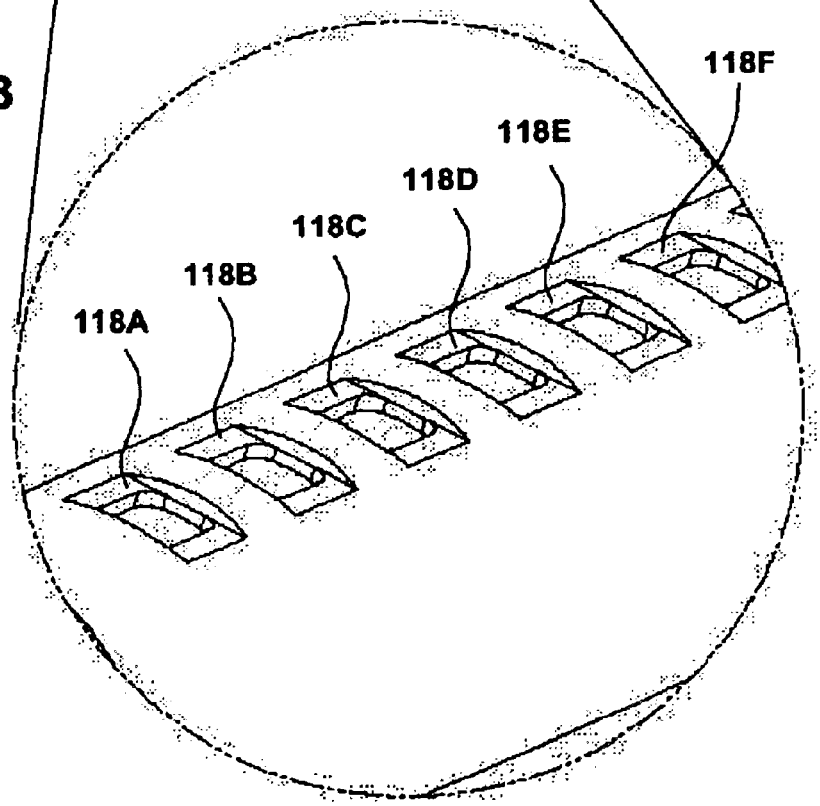
Figure 14:
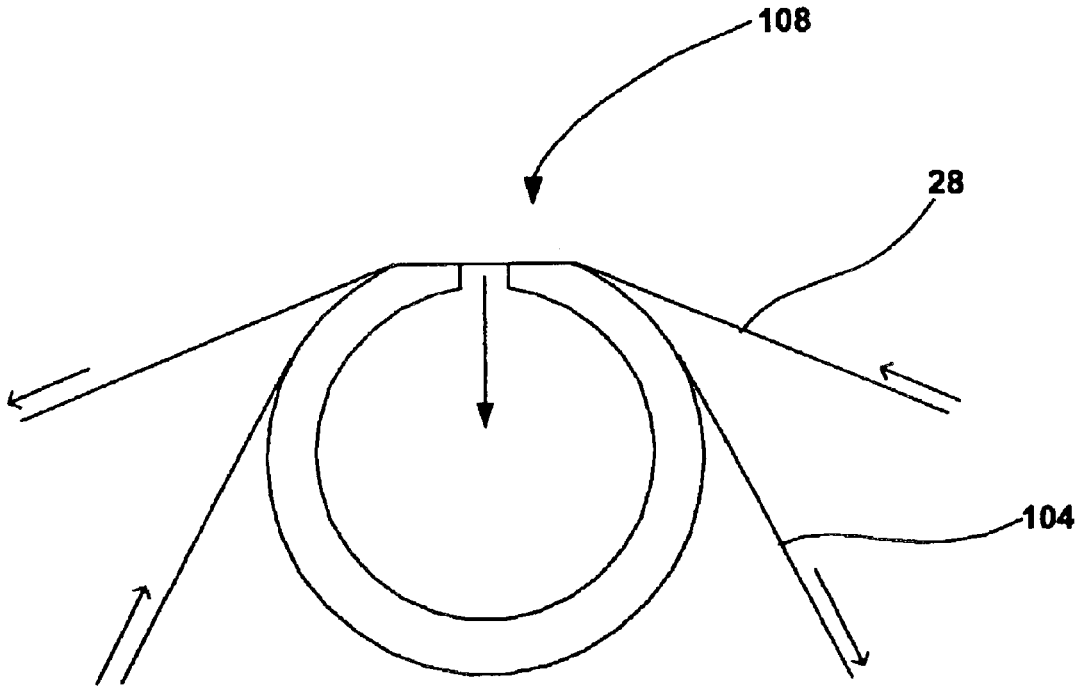
FIG. 14 is a cross-sectional view of a wipe head according to the invention.

FIGS. 13A, 13B and 14 illustrate one particularly effective embodiment of wipe head 108. FIG. 13A is a perspective view. FIG. 13B is a close-up view of a portion of FIG. 13A. FIG. 14 is a cross sectional view. Again, each wiping unit may include a wipe head similar to wipe head 108.

As illustrated in FIG. 13A, wipe head 108 includes a number of apertures (only apertures 118A–118F are labeled). The apertures 118 are in fluid communication with a vacuum (not shown), and thus a vacuum force can be observed at each aperture. In other words, a vacuum can be connected to wipe head 108 via vacuum line 126, and used to draw both the wiping material 104 and the individual narrow magnetic tape strands into apertures 118. This causes the edges of the individual narrow magnetic tape strands to be more effectively wiped clean.

FIG. 14 is a cross-sectional view of wipe head 108. As shown, a wiping material 104 passes over wipe head 108 in a first direction. Strands of narrow magnetic tape, e.g., the strands in set 28 pass over wipe head 108 in a second direction, which is opposite the first direction. A vacuum force (indicated by the arrow) pulls both the wiping material 104 and the strands of narrow magnetic tape against wipe head 108. In particular, the vacuum force may cause the individual strands to be pulled into the apertures so that wiping material 104 can more effectively remove debris from the edges of the strands of tape.

After being lapped and wiped, the sets of narrow magnetic tape strands 28, 29 are fed out of lapping station 32 and into re-spooling station 46. Re-spooling station 46 can re-spool the individual narrow magnetic tape strands to realize a number of tape pancakes that have been lapped and wiped. For example, rewind spool 48 can be used to re-spool the first set of narrow magnetic tape strands 28 and rewind spool 50 can be used to re-spool the second set of narrow magnetic tape strands 29. The rewind spools 48 and 50 may be motor driven to help pull the tape strands through the inline system.

In yet another embodiment, the lapping shoe of one or more of the lapping units described above may have vacuum drawn configuration similar to the wipe head illustrated in FIGS. 13A, 13B and 14. In that case, a vacuum drawn force may draw the lapping film and the tape strands into apertures to effectively lap the tape strands.

Additional features could also be added to the inline lapping system 20. For example, system 20 may include various air nozzle arrays (not shown), such as in the region where lapping film 80 passes over lapping shoe 90. These air nozzle arrays can ensure intimate contact between lapping film 80 and the tape strands, thus improving the lapping effect. Ionizer bars (not shown) could also be added to system 20 to reduce electrostatic charge generated between the lapping film and the strands of magnetic tape.

Re-spooling station 46 may also include tension control units to independently control the tension in the individual strands, i.e., the narrow magnetic tape strands. For example, a first tension control unit 52 can be used to independently control the tension in the strands in the first set of magnetic tape strands 28 and a second tension control unit 54 can be used to independently control the tension in the strands in the second set of magnetic tape strands 29.

Independent tension control can improve the inline lapping system by ensuring that tension is substantially the same in all strands of tape cut from the wide magnetic tape originally on roll 24. For instance, some individual strands may be stretched during the inline lapping process, thus causing variation between the tension in different strands of magnetic tape. The independent tension control units 52 and 54, however, can compensate for variations in tension to help ensure that lapping is consistent across different strands of magnetic tape.

Figure 15:
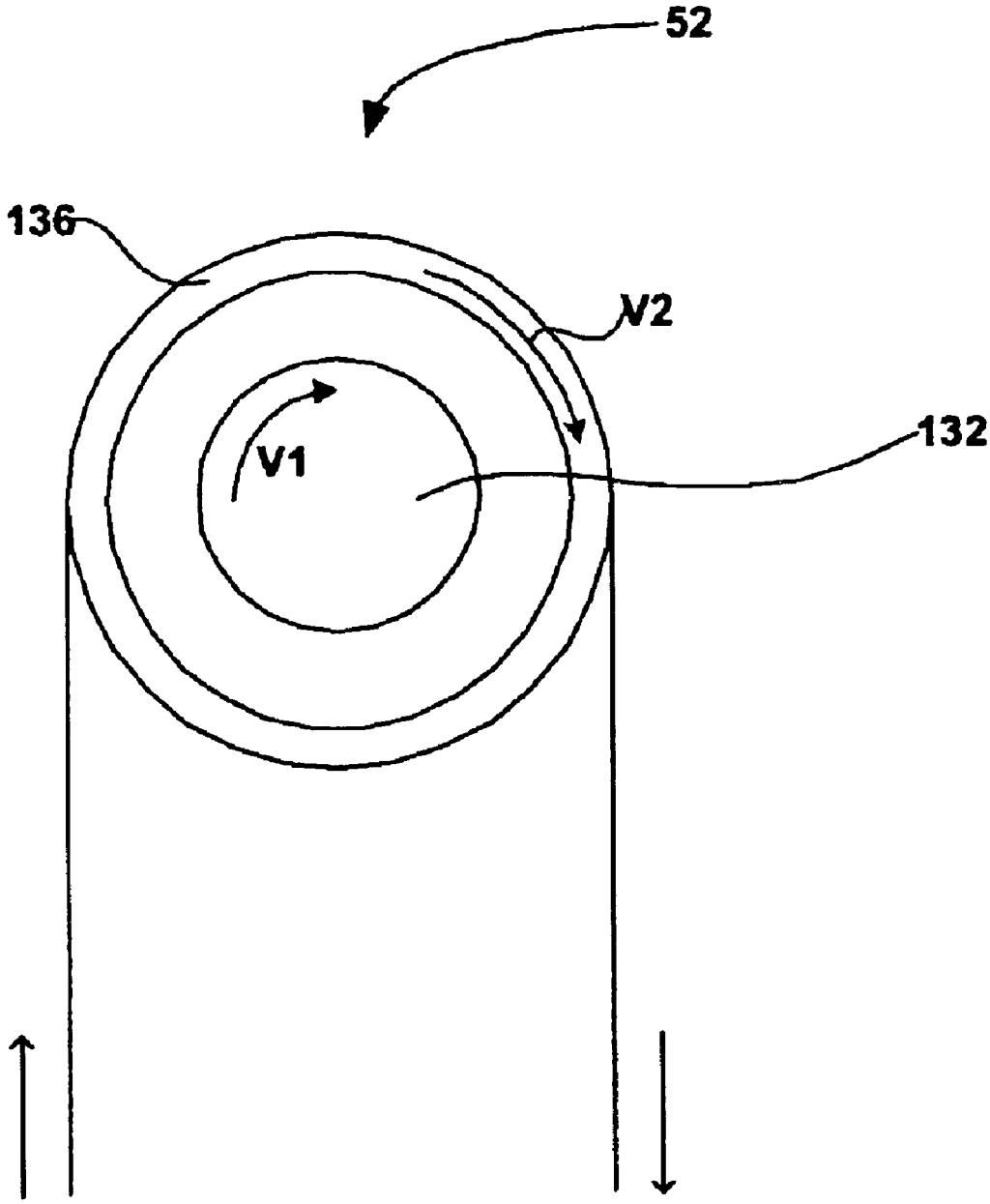
FIG. 15 is a cross-sectional view of a tension control unit in the form of a magnetic clutch mechanism.

In one embodiment, independent tension control units 52 and 54 each include a number of magnetic clutch mechanisms. For example, as illustrated in FIG. 15, independent tension control unit 52 has an inner cylinder 132 that includes magnetic material. The inner cylinder 132 may rotate at a constant first angular velocity (V1). Independent tension control unit 52 also includes a number of outer cylinders (one outer cylinder 136 illustrated), wherein each outer cylinder corresponds to one of the strands of tape in the first set of magnetic tape strands. Outer cylinder 136 and the other outer cylinders may be comprised of steel laminated with copper on the inner cylindrical surfaces of the outer cylinders. The outer surface of outer cylinder 136 and the other outer cylinders may be covered with a rubber material, or the like, to improve friction between the tape and the outer cylinders. Suitable magnetic clutch mechanisms are commercially available from a variety of vendors. For example, suitable clutch mechanisms may be purchased from Magnetic Technologies LTD of Oxford, Mass., U.S.A.

Tension control unit 52 can be used to independently control the tension in the individual strands of magnetic tape in the first set of narrow magnetic tape strands 28. Similarly, tension control unit 54 can be used to independently control the tension in the individual strands of magnetic tape in the second set of narrow magnetic tape strands 29. Individual tension control, in turn, can help ensure that the amount of lapping is consistent across different strands of tape.

The use of tension control units can create tension zones for each individual strand. In some embodiments, tension control units are located in a number of places throughout the inline lapping system to provide independent tension control zones in the slitting station, lapping station and rewind station. For example, a tension control unit could form part of rewind spools 48 and 50 to control tension in the rewind station, and tension control units 52 and 54 may control tension of strands in the lapping station. In addition, slitting station 26 may include tension control units such as a nipped pull roll, a vacuum pull roll, or a magnetic clutch mechanism to independently control tension in slitting station 26. Isolating tension in the lapping station from the slitting station and rewind station can ensure that each process in the inline system is calibrated to optimal tension. For example, the various tension control units can be calibrated according to the desired amount of tension in the various tension zones. More tension may be needed as more and more units or processes are included in any given tension zone. For example, the zone corresponding to lapping station 32 may require more tension if additional lapping units or wiping units are added to the system.

A number of embodiments of the invention have been described. For example, an inline lapping system has been described. Nevertheless, various modifications may be made without departing from the scope of the invention. For example, any number of lapping units and wiping units could be used in accordance with the invention. In addition, the inventive lapping station could be used with inline systems that include other manufacturing stations in addition to, or instead of, the slitting station. If used with a slitting station, the inline lapping station would not necessarily need to follow the slitting station. In other words, the tape could be lapped prior to slitting in an inline lapping system according to the invention. Accordingly, other embodiments are within the scope of the following claims.

What is claimed is:

1. A lapping station for magnetic tape comprising:

a first lapping unit that laps a first set of magnetic tape strands;

a second lapping unit that simultaneously laps a second set of magnetic tape strands, wherein each of the first and second lapping units include at least one tapping film that moves in a direction opposite motion of the first and second sets of magnetic tape strands respectively, and wherein the first and second sets of magnetic tape strands comprise strands cut from a wide roll of magnetic tape;

a first wiping unit that wipes the first set of magnetic tape strands; and a second wiping unit that simultaneously wipes the second set of magnetic tape strands, wherein each of the first and second wiping units includes a plurality of apertures and a vacuum in fluid communication with the apertures to respectively draw the magnetic tape strands in the respective sets of magnetic tape strands against a wiping material.

2. The lapping station of claim 1, wherein the first lapping unit adjustably engages the first set of magnetic tape strands, and wherein the second tapping unit adjustably engages the second set of magnetic tape strands.

3. A lapping station for magnetic tape comprising:

a first lapping unit that laps a first set of magnetic tape strands;

a second lapping unit that simultaneously laps a second set of magnetic tape strands;

a first wiping unit that wipes the first set of magnetic tape stands; and a second wiping unit that simultaneously wipes the second set of magnetic tape stands, wherein each wiping unit includes a vacuum in fluid communication with a number of apertures to respectively draw the magnetic tape strands in the respective set of magnetic tape strands against a wiping material.

4. The lapping station claim 3, wherein the wiping material of each wiping unit moves over the apertures in a direction opposite the magnetic tape stands.

5. The lapping station of claim 3, wherein the first lapping unit adjustably engages the first set of magnetic tape strands, wherein the first wiping unit adjustably engages the first set of magnetic tape stands, wherein to second lapping unit adjustably engages the second set of magnetic tape strands, and wherein the second set of wiping unit adjustably engages the second set of magnetic tape strands.

6. The lapping station of claim 3, further comprising:

a first number of lapping units that lap the first set of magnetic tape strands; and a second number of lapping units that simultaneously lap the second set of magnetic tape stands.

7. The lapping station of claim 6, wherein at least one of the first number of lapping units lap top sides of the first set of magnetic tape stands and at least one of the first number of lapping units lap bottom sides of the first set of magnetic tape strands, and wherein at least one of the second number of lapping units lap bottom sides of the second set of magnetic tape strands and at least one of the second number of lapping units lap bottom sides of the second set of magnetic tape strands.

8. The lapping station of claim 6, further comprising:

a first number of wiping units that wipe the first set of magnetic tape strands; and a second number of wiping units that simultaneously wipe the second set of magnetic tape strands.

9. A system comprising:

a slitting station that cuts a wide magnetic tape into a number of individual narrow magnetic tape strands, wherein the slitting station separates the number of individual narrow magnetic tape strands into even numbered individual narrow magnetic tape strands and odd numbered individual narrow magnetic tape strands;

a lapping station that simultaneously laps the individual narrow magnetic tape strands, wherein the lapping station includes a first lapping unit that laps even numbered individual narrow magnetic tape stands and a second lapping unit that simultaneously laps odd numbered individual narrow magnetic tape strands, wherein each of the first and second lapping units include at least one lapping film that moves in a direction apposite motion of the number narrow magnetic tape strands; and a re-spooling station that spools the number of individual narrow magnetic tape strands, wherein the re-spooling station includes a tension control unit to control tension in the number of individual marrow magnetic tape strands.

10. The system of claim 9, wherein the first lapping unit adjustably engages even numbered individual narrow magnetic tape strands, and wherein the second lapping unit adjustably engages odd numbered individual narrow magnetic tape strands.

11. The system of claim 9, wherein the lapping station further includes:

a first wiping unit that wipes even numbered individual narrow magnetic tape strands; and a second wiping unit that simultaneously wipes odd numbered individual narrow magnetic tape strands.

12. The system of claim 11, wherein the first lapping unit adjustably engages even numbered individual narrow magnetic tape strands, wherein first wiping unit adjustably engages even numbered individual narrow magnetic tape stands, wherein the second lapping unit adjustably engages odd numbered individual narrow magnetic tape strands, and wherein the second wiping unit adjustably engages odd numbered individual narrow magnetic tape strands.

13. A system comprising:

a slitting station that cuts a wide magnetic tape into a number of individual narrow magnetic tape strands, wherein the slitting station separates the number of individual narrow magnetic tape strands into even numbered individual narrow magnetic tape strands and odd numbered individual narrow magnetic tape strands;

a lapping station that simultaneously laps the individual narrow magnetic tape strands, wherein the lapping station includes a first lapping unit that laps even numbered individual narrow magnetic tape strands and a second lapping unit that simultaneously laps odd numbered individual narrow magnetic tape strands;

a first wiping unit that wipes even numbered individual narrow magnetic tape strands and a second wiping unit that simultaneously wipes odd numbered individual narrow magnetic tape strands, wherein each of the wiping units include a number of apertures that respectively draw the magnetic tape strands in the respective set of magnetic tape strands against wiping material; and a re-spooling station that spools the number of individual narrow magnetic tape strands, wherein the first lapping unit adjustably engages even numbered individual narrow magnetic tape strands, wherein first wiping unit adjustably engages even numbered individual narrow magnetic tape strands, wherein the second lapping unit adjustably engages odd numbered individual narrow magnetic tape strands, and wherein the second wiping unit adjustably engages odd numbered individual narrow magnetic tape strands.

14. The system of claim 9, wherein the re-spooling station includes a first tension control unit to independently control tension in each of the even numbered individual narrow magnetic tape strands and a second tension control unit to independently control tension in each of the odd numbered individual wow magnetic tape strands.

15. The system of claim 14, wherein each of the first and second tension control units include mechanisms.

* * * * *

UNITED STATES PATENT AND TRADEMARK OFFICE

CERTIFICATE OF CORRECTION

PATENT NO. : 6,811,472 B2
DATED : November 2, 2004
INVENTOR(S) : Tran et al.

It is certified that error appears in the above-identified patent and that said Letters Patent is hereby corrected as shown below:

Column 12,
Lines 35 and 52, “tapping” should read -- lapping --.
Lines 61 and 63, “stands” should read -- strands --.

Column 13,
Line 7, “stands, wherein to” should read -- strands, wherein the --.
Line 9, “unit” should read -- units --.
Lines 15, 18 and 42, “stands” should read -- strands --.
Line 47, “apposite” should read -- opposite --.

Column 14,
Line 12, “stands” should read -- strands --.
Line 54, “wow” should read -- narrow --.
Line 57, “mechanisms” should read -- magnetic clutch mechanisms --.

Signed and Sealed this

Fifth Day of July, 2005

JON W. DUDAS
*Director of the United States Patent and Trademark Office*